US006106037A

United States Patent [19]

Burton

[11] Patent Number: 6,106,037

[45] **Date of Patent: *Aug. 22, 2000**

[54] DOOR LATCH STRIKER

[75] Inventor: John E. Burton, Ludington, Mich.

[73] Assignee: ATF, Inc., Lincolnwood, Ill.

[ * ] Notice: This patent is subject to a terminal disclaimer.

[21] Appl. No.: 09/184,486

[22] Filed: Nov. 2, 1998

Related U.S. Application Data

[63] Continuation-in-part of application No. 09/119,472, Jul. 20, 1998.

[51] Int. Cl.[7] ..... E05B 15/02

[52] U.S. Cl. ..... 292/340; 292/DIG. 53

[58] Field of Search ..... 292/340, 341.11, 292/341.12, 341.13, 341.14, DIG. 38, DIG. 53, DIG. 56, DIG. 57, DIG. 64; 411/414, 411, 436, 167, 177, 369, 311, 353, 377

[56] References Cited

U.S. PATENT DOCUMENTS

| | | | |
|---|---|---|---|
| 2,217,892 | 10/1940 | Dodge | 292/340 |
| 2,772,903 | 12/1956 | Sussenbach . | |
| 3,175,454 | 3/1965 | Morse . | |
| 3,331,624 | 7/1967 | Pugh | 292/216 |
| 3,399,589 | 9/1968 | Breed . | |
| 3,572,797 | 3/1971 | Shay . | |
| 3,591,225 | 7/1971 | Hagemeyer . | |
| 3,680,902 | 8/1972 | Slattery | 292/341.14 |
| 4,130,308 | 12/1978 | Jeavons . | |
| 4,323,271 | 4/1982 | Taniguchi . | |
| 4,357,039 | 11/1982 | Tölle . | |
| 4,466,645 | 8/1984 | Kobayashi . | |
| 4,834,435 | 5/1989 | Kleefeldt . | |
| 4,883,298 | 11/1989 | Kleefeldt . | |
| 4,907,926 | 3/1990 | Wing | 411/366 |
| 4,911,488 | 3/1990 | Brackmann et al. . | |
| 4,941,696 | 7/1990 | Yamada et al. . | |
| 4,981,313 | 1/1991 | Makamura . | |
| 4,998,759 | 3/1991 | Peterson et al. . | |
| 5,000,495 | 3/1991 | Wolfgang et al. . | |
| 5,050,917 | 9/1991 | Hamada et al. . | |
| 5,127,784 | 7/1992 | Eslinger | 411/414 |
| 5,209,531 | 5/1993 | Thau . | |
| 5,215,342 | 6/1993 | Yuge et al. . | |
| 5,263,752 | 11/1993 | Phail-Fausey et al. . | |
| 5,306,067 | 4/1994 | Hull et al. . | |
| 5,328,219 | 7/1994 | Konchan et al. . | |
| 5,348,357 | 9/1994 | Konchan et al. . | |
| 5,452,944 | 9/1995 | Bear . | |
| 5,494,324 | 2/1996 | Kleefeldt . | |
| 5,494,391 | 2/1996 | Zhou . | |
| 5,501,495 | 3/1996 | Claucherty . | |
| 5,520,426 | 5/1996 | Arabia, Jr. et al. . | |
| 5,529,356 | 6/1996 | Cetnar . | |
| 5,632,517 | 5/1997 | Paulik et al. . | |
| 5,707,092 | 1/1998 | Van Slembrouck et al. . | |
| 5,716,085 | 2/1998 | Kobayashi . | |
| 5,735,558 | 4/1998 | Watanabe . | |
| 5,882,160 | 3/1999 | Iwata | 411/307 |

*Primary Examiner*—Anthony Knight
*Assistant Examiner*—Gary Estremsky
*Attorney, Agent, or Firm*—Brian G. Gilpin; Godfrey & Kahn, S.C.

[57] ABSTRACT

A vehicle door striker is manufactured from a U-shaped striker plate and a striker bolt. The striker plate has a mounting plate connected to an arm by a support segment. The mounting plate has a striker bolt hole and two mounting bolt holes therethrough and the arm has a boss with a threaded hole therethrough. The striker bolt has a head and a threaded end with a shaft therebetween. The shaft is surrounded by a profiled plastic sleeve which serves to dampen sound and reduce wear. In assembling the vehicle door striker, the striker bolt is inserted through the striker bolt hole such that the head is fully recessed in the mounting plate and such that the threaded end is threaded into the threaded hole of the boss. The striker bolt and threaded hole interface in an interference fit designed to maximize the failure point of the connection. The sleeve may be placed over the shaft of the striker bolt either before or during the assembly process. A plastic cover substantially envelops the striker plate to provide sound dampening and to further protect the vehicle door striker.

20 Claims, 9 Drawing Sheets

DOOR LATCH STRIKER

CROSS-REFERENCE TO RELATED APPLICATION

This application is a continuation-in-part of U.S. patent application Ser. No. 09/119,472, filed Jul. 20, 1998.

FIELD OF THE INVENTION

This invention relates generally to door latch strikers and more particularly to a vehicle door latch striker, which may be at least partially covered with plastic, having a threaded striker bolt.

BACKGROUND OF THE INVENTION

The sound made by a vehicle's door when closing is a characteristic often identified by consumers with the quality of the vehicle's construction. It is particularly appealing to potential new vehicle purchasers, and, not surprisingly, particularly important to vehicle manufacturers, that the vehicle doors make a solid and secure sound when they are shut. This sound is dependent, in large part, on the nature and quality of the door latch and striker designs and the interaction between the two parts. A hollow or tinny sound full of vibrations and reverberations is undesirable and a solid, vibration-free sound is preferred.

Various safety requirements, including those set by governmental agencies and vehicle manufacturers, dictate that striker bolts and door latching systems resist opening in the event of a crash or other mishap so as to protect the occupants of the vehicle from injury. In fact, out of an extraordinary concern for safety, vehicle manufacturers typically set safety requirements more stringent than those which are governmentally imposed.

Automobiles and other vehicles are generally equipped with a latch in the end of each door that engages a striker secured to the vehicle body pillar at the edge of the door opening. The latch in the door typically includes a slot that opens toward the vehicle interior and extends through a cutout in the face plate of the door. This slot guides the latch over the striker as the vehicle door is closed. As the latch moves over the striker, a pivotally mounted fork bolt that is part of the latching mechanism "strikes" and engages the striker. The striker causes the fork bolt to rotate to a latched position wherein the fork bolt engages the striker to hold the door closed. The fork bolt is held in the latched position until it is released by actuation of a door handle or other mechanism.

Examples of existing door latch mechanisms are disclosed, for example, in U.S. Pat. Nos. 4,130,308 to Jeavons; 5,000,495 to Wolfgang et al.; 5,520,426 to Arabia Jr. et al.; 5,348,357 to Konchan et al.; and 5,632,517 to Paulik et al. These door latches secure the vehicle door to the door frame by engagement with a door latch striker attached to the vehicle frame. Existing door latch strikers generally have a bolt or projection that is riveted to a base or bracket that secures the striker to the door pillar. Examples of such designs are disclosed in a number of U.S. Pat. Nos. including U.S. Pat. Nos. 4,941,696 to Yamada et al.; 4,998,759 to Peterson et al.; 5,050,917 to Hamada et al.; 5,209,531 to Thau; and 5,707,092 to Van Slembrouck et al. Each of these designs and many other conventional designs suffer from several limitations and drawbacks, most notably, a weak rivet connection which cannot effectively meet the vehicle manufacturers' more stringent safety standards for securing vehicle doors in the closed position. The use of a rivet connection limits the ability to use high strength or heat treated materials for the striker bolt and the base or mounting plate. Thus, a major cause of failure of the door latching mechanism in vehicles is the failure of the striker bolt itself or failure of the rivet connection between the striker bolt and the mounting plate. Also, these striker bolt designs do not result in the preferred solid, reverberation-free closing sound that is sought by vehicle consumers and manufacturers.

Conventionally, strikers have almost exclusively been made entirely of metal. This results in an unpleasant sounding metallic impact and friction when engaging with door latches, and may cause uneven contact with a latch or a guide piece and/or may cause play in the engagement between the striker and the door latch after excessive wear. These occurrences impair durability as a result of wear and breakage and may cause annoying or unappealing noises. There have been several attempts made to solve the problems existing in conventional strikers, some of which include the use of plastic or other polymeric or elastomeric material. However, as explained in further detail below, each of these attempts has some drawbacks and does not fully satisfy the needs of vehicle manufacturers.

U.S. Pat. Nos. 4,466,645 to Kobayashi and 4,981,313 to Makamura disclose the use of a plastic material overmolded over a conventional U-shaped, riveted striker assembly. The objective of providing the plastic overmolding is better noise reduction when the door latch engages the striker. However, such designs are subject to excessive wear at the point where the latch mechanism engages the striker. After repeated engagements, the plastic coating may be so fully worn at the impact point that the metal latching mechanism impacts the metal bolt causing the problems outlined above.

U.S. Pat. No. 5,215,342 to Yuge et al. discloses generally a striker with a plastic cover. The striker includes a base plate; a plastic overmolded, generally U-shaped rod riveted to the base plate; and a molded plastic cover sized to cover a major surface of the base plate to provide an attractive appearance. The cover has an elongate slit which is constructed to permit the U-shaped rod to pass therethrough and the cover includes two circular openings sized as to make a latched engagement when the plastic cover is properly attached to the base plate. This striker assembly also suffers from the deficiencies described above with respect to the assemblies disclosed in U.S. Pat. Nos. 4,466,645 and 4,981,313. Additionally, the engagement of the plastic cover requires an additional step in the automobile assembly process.

A more recent striker design, shown in FIG. I and identified generally as A, includes a plate B and a bolt C. The plate B is stamped into a generally U-shaped piece having striker bolt holes D and E and mounting bolt holes F therethrough. The striker bolt C slides through striker bolt hole D and is riveted in place through striker bolt hole E to close the U-shape of the plate B. The striker A is affixed to the door frame through the mounting bolt holes F. This design suffers from several of the limitations described above, e.g., the riveting of the striker bolt cannot meet strength objectives and the metal on metal impact and friction causes an undesirable closing sound and may lead to play in the engagement between the striker and door latch after excessive wear. The use of a smooth-bore extruded plastic sleeve around the bolt C is similar to the overmolded designs discussed above. Such a sleeve does not absorb a significant amount of impact energy and, if the sleeve is tightly fitted around the bolt so that it is not free to rotate, the sleeve is prone to wear after repeated strikings by the latch in the same place.

Accordingly, a need exists for a vehicle door striker that is capable of meeting or exceeding manufacturer safety requirements for door latches, has an attractive appearance, is cost effective to manufacture and install on the automobile, and makes the solid, reverberation-free closing sound that is appealing to vehicle consumers and manufacturers.

SUMMARY OF THE INVENTION

Therefore, it is an object of the present invention to provide a vehicle door striker that is capable of exceeding governmental and the more stringent vehicle manufacturer safety requirements. It is a further object of the invention to provide a vehicle door striker that has an attractive appearance. It is an additional object of the invention to provide a vehicle door striker that is durable and cost effective to manufacture and to install on the automobile. It is yet another object of the invention to provide a vehicle door striker that makes a sound when the door is closed that is appealing to consumers. It is still a further object of the present invention to provide a vehicle door striker that overcomes the disadvantages of the prior art. The vehicle door striker of the present invention provides the above identified and many additional objects by providing a striker that includes very few parts, is easily assembled and installed, is of very high strength, provides the solid, reverberation-free closing sound that is appealing to consumers and manufacturers, and is cost effective.

As described in more detail below and shown in the accompanying drawings, the vehicle door striker of the present invention includes a generally U-shaped striker plate formed from stamped steel. One arm of the U includes a mounting plate with mounting bolt holes and a striker bolt hole therethrough. The other arm of the U is a support arm that has a threaded boss with a hole therethrough substantially in axial alignment with the striker bolt hole in the mounting plate. A striker bolt is inserted through the striker bolt hole in the mounting plate and is threaded into the threads of the boss. The threads on the striker bolt and the threads in the boss are preferably configured so as to create an interference fit that increases the shear strength of the threaded connection. When so configured, the failure point of the connection between the bolt and the arm is increased. The use of a threaded connection in the boss provides a much stronger connection than is achieved in convention riveted connection. Moreover, if a particular application requires exceptional strength, higher strength steel for the bolt and the plate can be used with the present invention than can be used with conventional riveted striker bolts. The threaded connection also helps retain the support arm in position and helps prevent it from collapsing if impacted. In one embodiment of the invention, a threaded connection in accordance with the present invention is incorporated into existing striker designs and configurations to achieve a higher strength connection.

The striker bolt may be fitted with a sleeve made from extruded or injection molded plastic, polyurethane, nylon, or other suitable material. The sleeve can be slid over the bolt before or as it is threaded into the boss, however, assembly is facilitated by sliding the sleeve over the bolt before inserting the bolt through the striker bolt hole. In one embodiment, the striker bolt has a smooth exterior surface with a profiled plastic sleeve fitted over the exterior diameter of the bolt so as to leave at least some space between the parts. The sleeve is preferably substantially free to rotate around the bolt when impacted by the door latch. The use of the profiled plastic sleeve provides both better noise reduction and better wear resistance than can be achieved with a smooth-bore sleeve. In alternative embodiments, the interior surface and/or the exterior surface of the sleeve may have a variety of shapes which are designed to affect the noise produced when the door is closed or to resist wear. Instead of a smooth shape, the surface of the striker bolt is configured in a series of annular rings along its length or may be splined. Such shapes also affect noise and wear resistance. In another alternate embodiment, the sleeve is overmolded over the striker bolt and is not free to rotate. In yet another embodiment, the sleeve is formed from two layers of material having different characteristics, e.g., a hard outer impact layer and a softer cushioning interior layer.

In an additional embodiment, the striker assembly is covered with a plastic cover so as to provide an attractive appearance, further reduce noise, and further resist wear and corrosion. In this embodiment, a one-piece cover slides over the U-shaped striker plate. The striker bolt is then threaded into the boss to lock the cover over the plate and complete the striker assembly. The plastic cover may include an integrated sleeve or one of the previously described extruded, injection molded, or overmolded sleeves may be used. If an integrated sleeve is used, there is preferably a gap between the bolt and the sleeve so as to isolate and dampen sound. When the cover is used, the striker assembly is fully insulated from the car body to help dampen noise and prevent vibration.

As previously noted, the mounting plate of the U-shaped striker plate has striker bolt holes therethrough. The striker can be affixed to the vehicle door frame through the mounting bolt holes. In the plastic cover embodiment, the mounting bolts may be partially inserted through the mounting bolt holes and held in place by interference with the plastic cover. Such an arrangement provides the installer with a complete door latch striker package which facilitates assembly line installation of the striker plate on the door frame.

In sum, the present invention represents a significant improvement over the prior art in many ways. Vehicle door strikers in accordance with the present invention are capable of exceeding governmental and the more stringent vehicle manufacturer safety requirements, are durable and cost effective, and make a solid, reverberation-free closing sound that is appealing to vehicle consumers and manufacturers. These and other objects and advantages of the present invention will become apparent from the detailed description and accompanying drawings.

DETAILED DESCRIPTION

Figure 1:
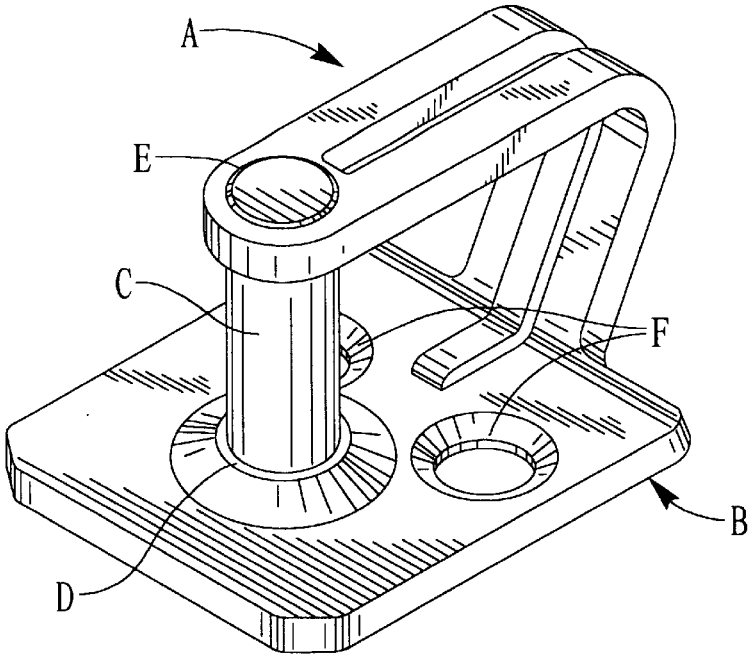
FIG 1 PRIOR ART
FIG. 1 is a perspective view of a prior art door latch striker including a U-shaped stamping and a bolt riveted between the legs of the U.

Referring now to FIGS. 2–5, the vehicle door striker of the present invention, identified generally as 20, preferably includes a substantially U-shaped striker plate 22 formed from stamped steel. One arm of the U is formed into a mounting plate 24 with mounting bolt holes 26 and a striker bolt hole 28 therethrough. Opposite from the striker plate 22 in the U is an arm 30 that includes a boss 32 with a threaded hole 34 therethrough substantially in axial alignment with the striker bolt hole 28 in the mounting plate 24. The mounting plate 24 and arm 30 are connected by a support segment 31. The striker plate 22 may include a strengthening ridge 35 running from the mounting plate 24 to the arm 30 or along portion thereof. The strengthening ridge 35 provides additional strength to the support segment 31 and the striker plate 22 in general and helps prevent deformation thereof. While the striker plate 22 is preferably stamped steel coated with zinc for corrosion resistance, other high strength, corrosion resistant materials may be used. If additional strength is required in a particular application, highly heat-treated or high strength steel may be used. The boss 32 is preferably formed by extrusion during a stamping and bending process used to form the striker plate 22 and threads are formed within the hole 34 using any conventional means. Of course, other methods, such as machining or casting, may be used to form the striker plate 22, but it has been found that stamping is both economical and effective. Alternatively, a threaded hole 34 could be provided directly in arm 30 without having a boss 32. However, the boss 32 provides additional strength and stability to the threaded connection and allows the use of more economical material for the striker plate 22 than would be required without the boss 32.

Figure 2:
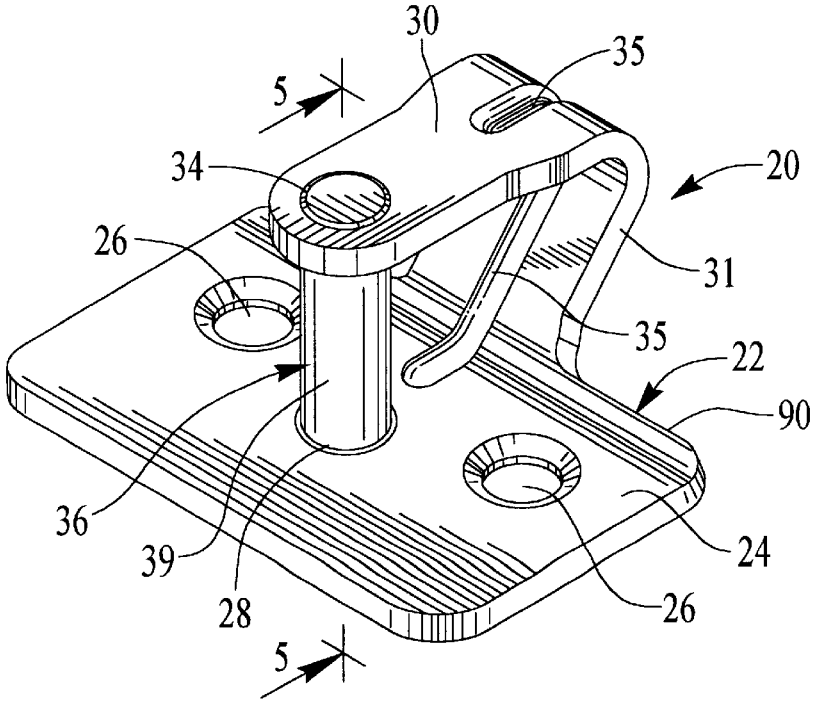
FIG. 2 is a perspective view of a door latch striker constructed in accordance with one embodiment of the present invention.
Figure 5:
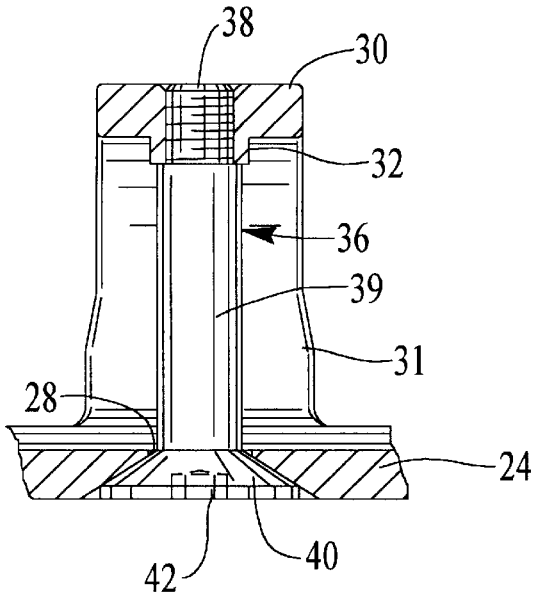
FIG. 5 is a partial cross-sectional view of the door latch striker shown in FIG. 2 taken generally along the line 5—5.

As illustrated in FIGS. 2 and 5, a striker bolt 36 is inserted through the striker bolt hole 28 in the mounting plate 24. The striker bolt 36 has a threaded end 38, a shaft 39, and a head 40 including a driving means 42 (shown in phantom in FIG. 5) which may be TORX®, hexagonal, octagonal, or other suitable shape. The shaft 39 of the bolt 36 may have a greater diameter than the threaded end 38. The threaded end 38 of the striker bolt 36 is threaded into the threaded hole 34 in the boss 32. The use of a threaded connection provides relatively great strength as compared to a riveted connection and allows the use of much higher strength steel, e.g., highly heat-treated, for the striker bolt 36 and/or the striker plate 22 than is used with conventional riveted striker bolts (see FIG. 1). This is because a riveted connection requires that the rivet end of the striker bolt and the corresponding hole in the striker plate have an ample degree of formability, and a correspondingly lower material hardness and strength, or the rivet connection cannot be made. The threaded connection between the striker bolt 36 and the arm 30 helps secure the shape of the U-shaped striker plate 22 and helps protect it from deformation in case of impact by not allowing the arm 30 to move at the threaded connection point. The striker bolt hole 28 in the mounting plate 24 is dimensioned such that the head 40 of the striker bolt 36 can be fully recessed in the mounting plate 24. The striker bolt 36 is threaded into the threaded hole 34 in the boss 32 until the end of the bolt 36 is substantially flush with the outside of the arm 30. After the striker bolt 36 is threaded into place, mounting bolts 44 can be inserted through the mounting bolt holes 26 in the mounting plate 24 to secure the striker 20 to the vehicle door frame. While the striker bolt 36 and the mounting bolts 44 are preferably cold headed zinc coated steel, other high strength, corrosion resistant materials may be used.

Figure 3:
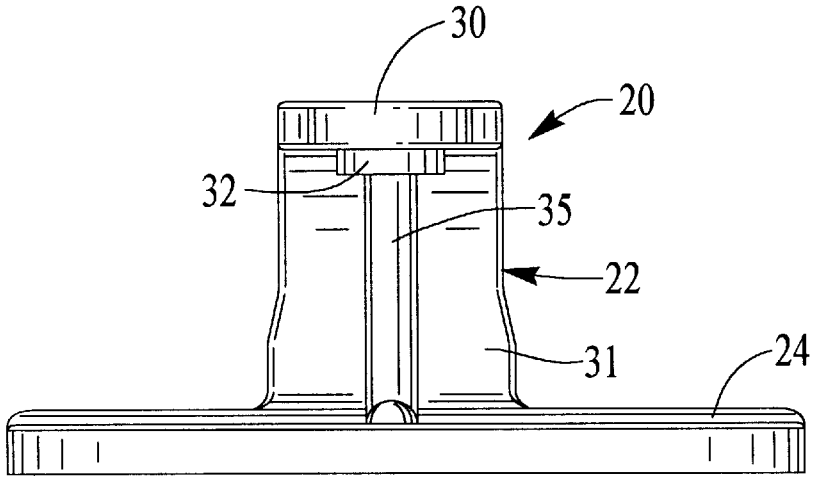
FIG. 3 is a front elevational view of a door latch striker constructed in accordance with one embodiment of the present invention.
Figure 4:
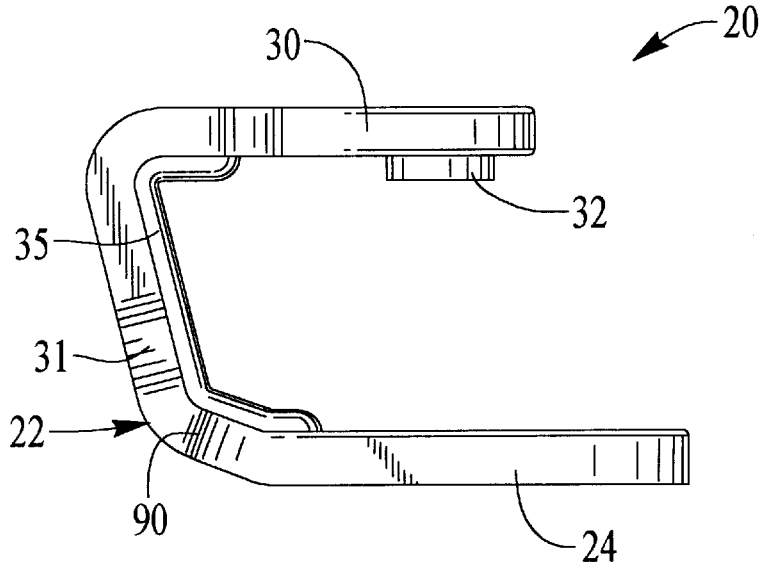
FIG. 4 is a side elevational view of a door latch striker constructed in accordance with one embodiment of the present invention.

In another embodiment of the present invention, a threaded connection as described herein may be substituted for the riveted connection used in existing striker designs and configurations to achieve a higher strength connection. Such a connection preferably includes a boss (e.g., as shown in FIGS. 3 and 4 as part number 32) as part of the support or stabilizing arm or crossbar into which the threaded portion of the striker bolt is threaded. In such an embodiment, the connections between the legs and the crossbar depicted in U.S. Pat. No. 5,707,092 are made significantly stronger by replacing the riveted connection with a threaded connection in accordance with the present invention.

In still another embodiment of the present invention, a prior art riveted striker, such as the one shown in U.S. Pat. No. 5,707,092, can be strengthened and thus become more able to satisfy the needs of automotive manufacturers by adding an extruded boss such as boss 32 in FIGS. 3 and 4 to any or all of the riveted connections between the striker bolts and the mounting plate and/or the support arm. However, to provide a stronger connection, it has been found advantageous to use a threaded connection as described herein.

Figure 6:
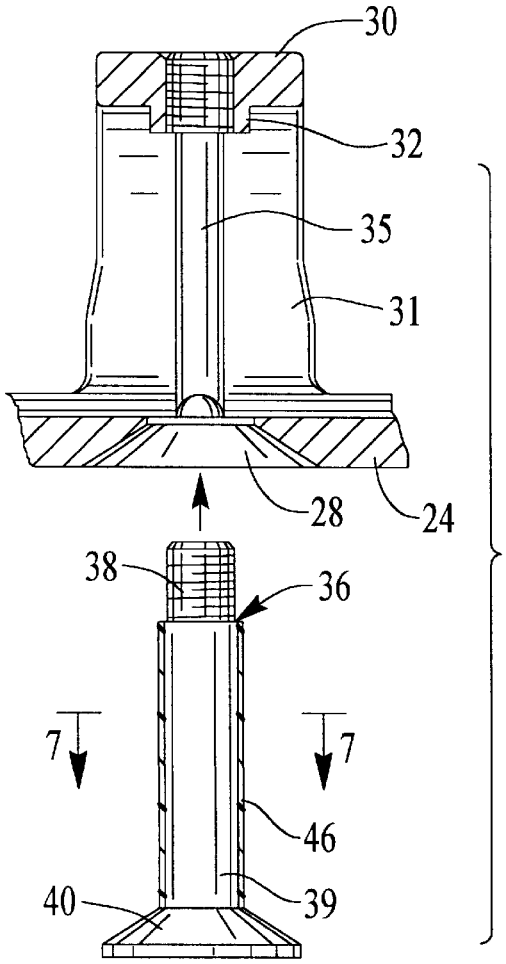
FIG. 6 is a partially exploded, partial cross-sectional view of the door latch striker shown in FIG. 5.

As shown in FIG. 6, the shaft 39 of the striker bolt 36 may be fitted with a sleeve 46 made from extruded or molded plastic. The sleeve 46 can be slid over the shaft 39 before or as the striker bolt 36 is threaded into the boss 32. As such, the striker bolt hole 28 must be of a sufficient diameter so as to accommodate the striker bolt 36 with the sleeve 46 in place. In the embodiment shown in FIGS. 6 and 7, the shaft 39 has a smooth round exterior surface 48 and the sleeve 46 has a smooth round interior surface 50 and impact surface 54. The interior surface 50 of the sleeve 46 is slightly larger than the exterior surface 48 of the shaft 39 thus providing a slight gap or space 52 between the bolt 36 and the sleeve 46. As such, the sleeve 46 is free to rotate around the shaft 39 of the striker bolt 36 when the striker 20 is impacted by the vehicle door latch. Such an arrangement provides some noise reduction and wear resistance advantages. Noise reduction as compared to a metal-only striker bolt or a plastic overmolded striker bolt is achieved because the shape of the sleeve 46 is deformed to provide sound dampening and some absorption of the impact energy when the striker 20 is impacted by the latch. Wear resistance is improved because the impact pressure of the latch upon the striker 20 is distributed over an increased contact area and the sleeve 46 is free to rotate such that the same point of the impact surface 54 of the sleeve 46 is not always struck by the latch when the door is closed.

Nylon and polyurethane have been found to be acceptable materials for forming the sleeve 46 but a wide variety of plastic, other polymeric, or elastomeric materials could also be used and it is within the ability of one of ordinary skill in the art to select an appropriate material. Similarly, while an extrusion process has been found most cost-effective in forming the sleeve 46, other processes such as injection molding could be used.

Figure 7:
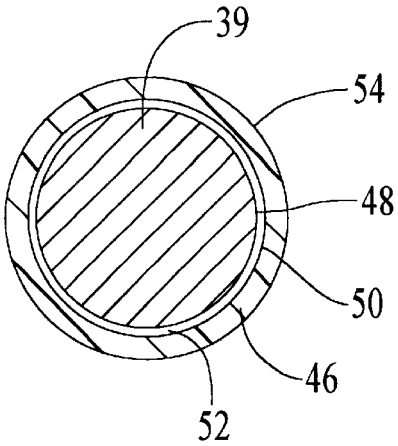
FIG. 7 is a cross-sectional view of the striker bolt shown in FIG. 6 taken generally along the line 7—7.
Figure 8:
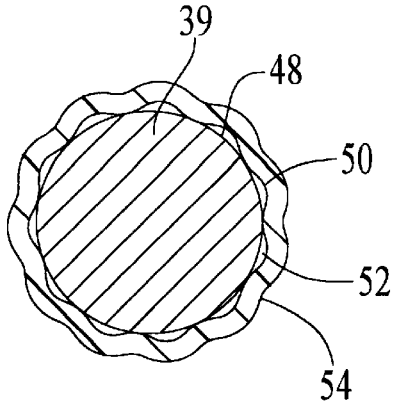
FIG. 8 is a cross-sectional view of the striker bolt and an alternative embodiment of the sleeve.
Figure 9:
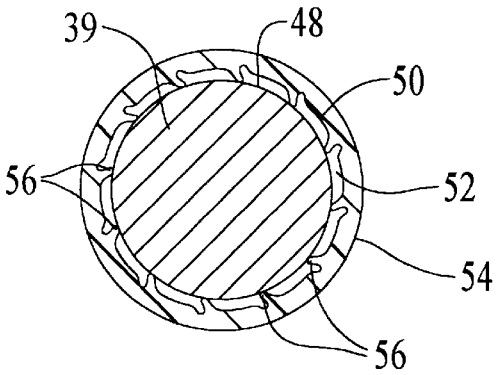
FIG. 9 is a cross-sectional view of the striker bolt and an alternative embodiment of the sleeve.
Figure 10:
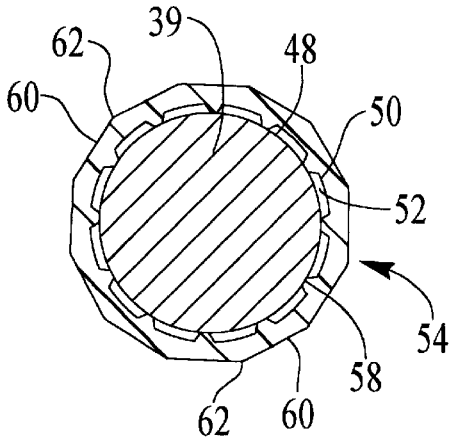
FIG. 10 is a cross-sectional view of the striker bolt and an alternative embodiment of the sleeve.
Figure 11:
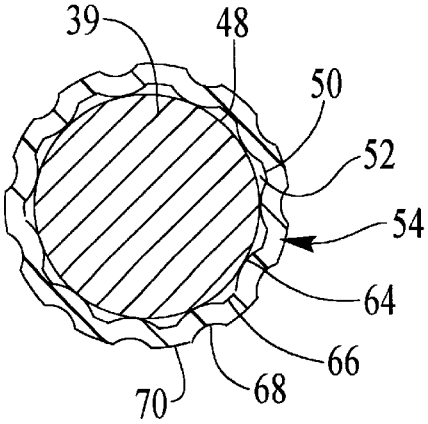
FIG. 11 is a cross-sectional view of the striker bolt and an alternative embodiment of the sleeve.
Figure 21:
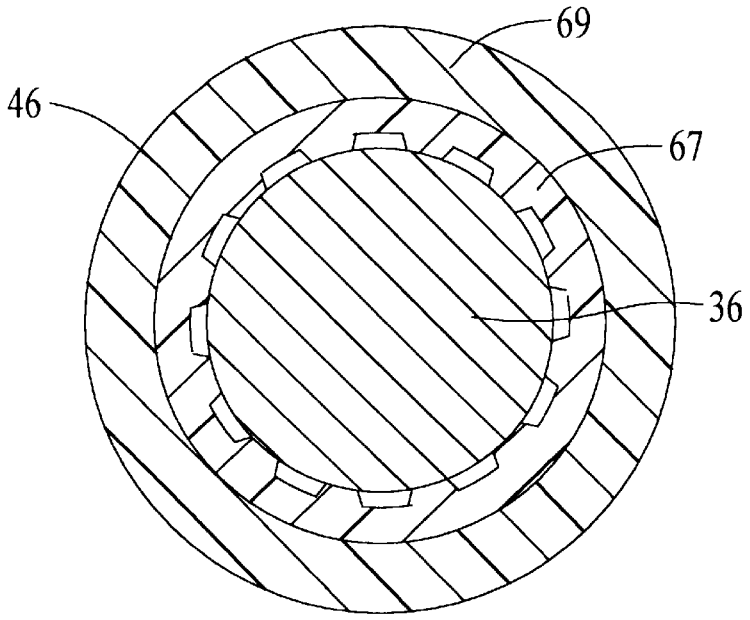
FIG. 21 is a cross-sectional view of the striker bolt and an alternative embodiment of the sleeve.

FIGS. 8–11 show several alternatives to the smooth round interior surface 50 and smooth round impact surface 54 of the sleeve 46 shown in FIGS. 6 and 7. The alternative embodiments of the sleeve 46 have shaped or profiled surfaces so as to provide significantly greater noise reduction advantages as compared to the smooth-surface sleeve 46. In the alternative embodiments shown, which by no means is an exhaustive array of the possible designs, the interior surface 50 and/or the impact surface 54 of the sleeve 46 have a variety of shapes. Each of the alternative embodiments in FIGS. 8–11 allows the sleeve 46 to rotate around the shaft 39 of the bolt 36 and includes at least some space 52 between the sleeve 46 and the bolt 36. FIG. 8 shows an embodiment with a wavy interior surface 50 of the sleeve 46 with a correspondingly wavy impact surface 54. FIG. 9 shows an embodiment with an interior surface 50 with angled longitudinal ridges 56 running the length of the sleeve 46 with a smooth exterior impact surface 54. FIG. 10 shows an embodiment with an interior surface 50 with pointed longitudinal projections 58 along the length of the sleeve 46 and a slightly out-of-round impact surface 54 (the impact surface 54 has straight segments 60 connected by rounded segments 62). FIG. 11 shows an embodiment with an interior surface 50 having rounded longitudinal protuberances 64 with flattened interstices 66 therebetween and an impact surface 54 with corresponding rounded 68 and flattened 70 sections. FIG. 21 shows a two-layered embodiment of the sleeve 46 with a profiled underlying layer 67 and a smooth exterior layer 69. The profile of the inner layer 67 may be one of those disclosed above or any other effective design. The inner layer 67 is preferably softer than the outer layer 69 and provides cushioning for the impact of the latch while the harder and more wear resistant exterior layer 69 is capable of withstanding the repeated impact of the latching mechanism.

Of course, other alternatives to the embodiments disclosed herein are possible. The best sounding and wearing design for a particular application depends on the door, latching mechanism, and overall vehicle design, and the use of a profiled sleeve has been found to be particularly effective in providing noise reduction.

FIGS. 12–14A illustrate one alternative to the smooth round exterior surface 48 of the shaft 39 of the striker bolt 36. Instead of the smooth round exterior surface 48, the shaft 39 may have a series of annular rings 72 along its length, the shaft 39 may have splines 74, or another type of contoured, threaded, or ridged exterior surface may be used. Such shapes affect noise and wear resistance and different shapes provide the most preferable sound and wear resistance in different applications. While the types of sleeves 46 previously discussed may be used with shaped striker bolts 36, it has been found effective to use an overmolding process to mold a plastic sleeve 76 around the shaft 39 of the bolt 36. Of course, the overmolding process may also be used for the previously discussed shaft 39 with a smooth round exterior surface 48. However, if the overmolding process is used, the sleeve 76 is not free to rotate around the shaft 39.

Figure 12:
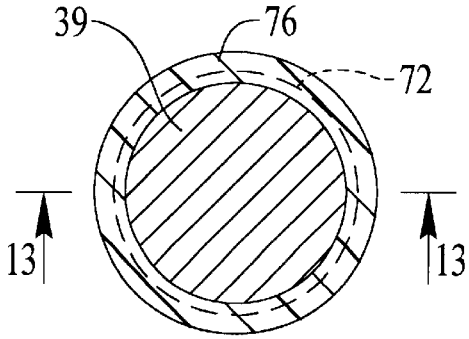
FIG. 12 is a cross-sectional view of an alternative embodiment of the striker bolt and an alternative embodiment of the sleeve, the crests of annular rings along the length of the bolt being shown in phantom.
Figure 13:
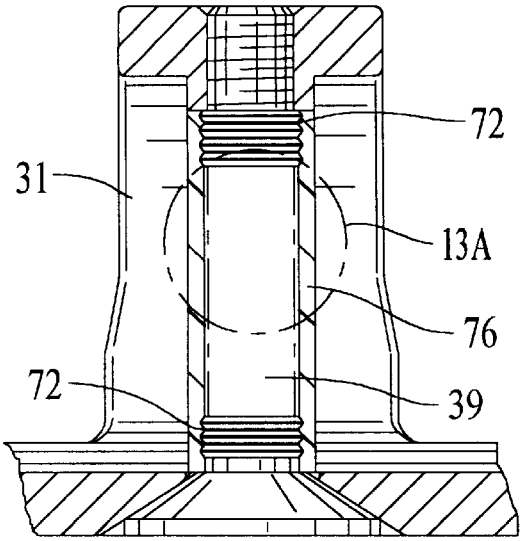
FIG. 13 is a partial cross-sectional view of the striker bolt and sleeve shown in FIG. 12 with the striker bolt shown threaded into the striker plate, the annular rings continuing along the length of the shaft of the striker bolt as shown by phantom lines.
Figure 13A:
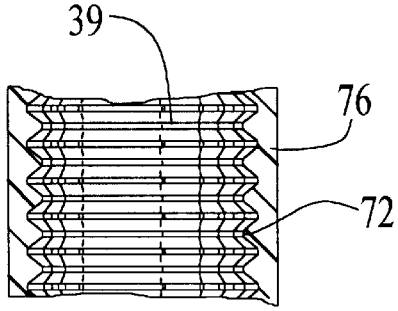
FIG. 13A is a detail of the striker bolt and sleeve shown in FIG. 13 taken generally in the area designated 13A.
Figure 14:
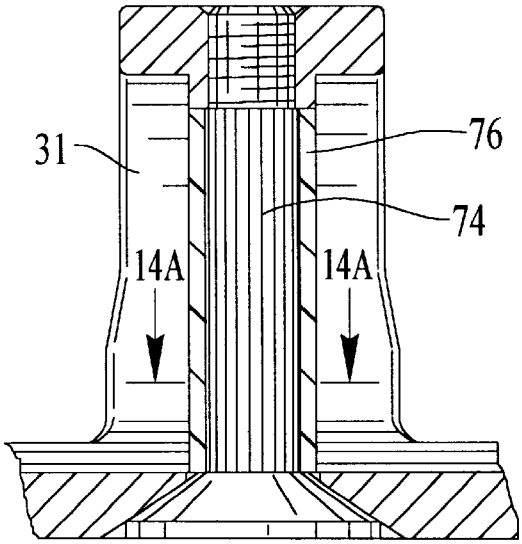
FIG. 14 is a partial cross-sectional view of an alternative embodiment of the striker bolt and an alternative embodiment of the sleeve with the striker bolt shown threaded into the striker plate.
Figure 14A:
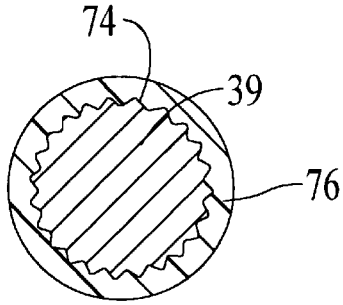
FIG. 14A is a cross-sectional view of the alternative embodiment of the striker bolt and sleeve shown in FIG. 14 taken generally along the line 14A—14A.
Figure 15:
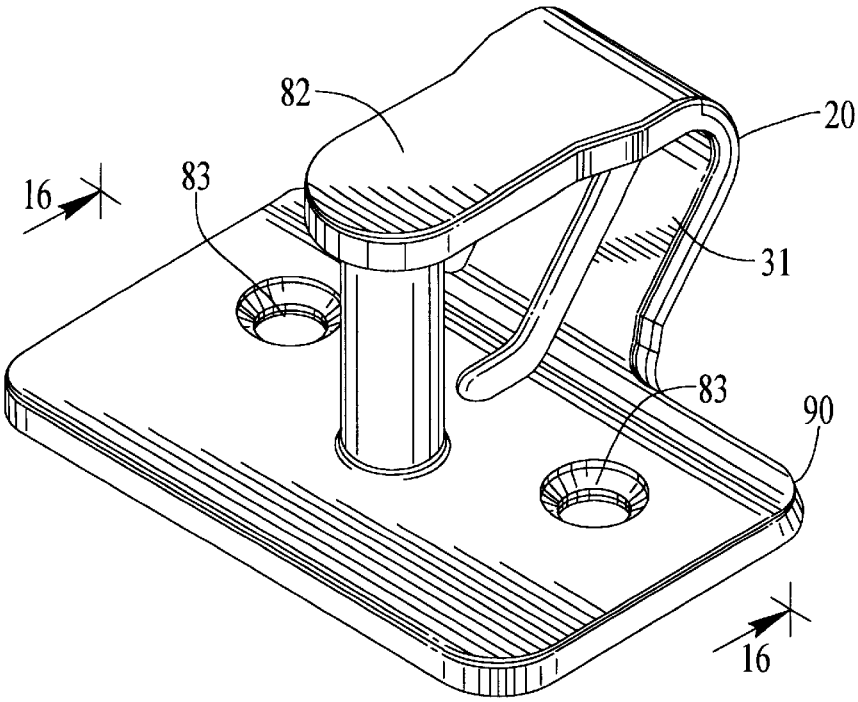
FIG. 15 is a perspective view of a door latch striker constructed in accordance with one embodiment of the present invention including a cover.
Figure 16:
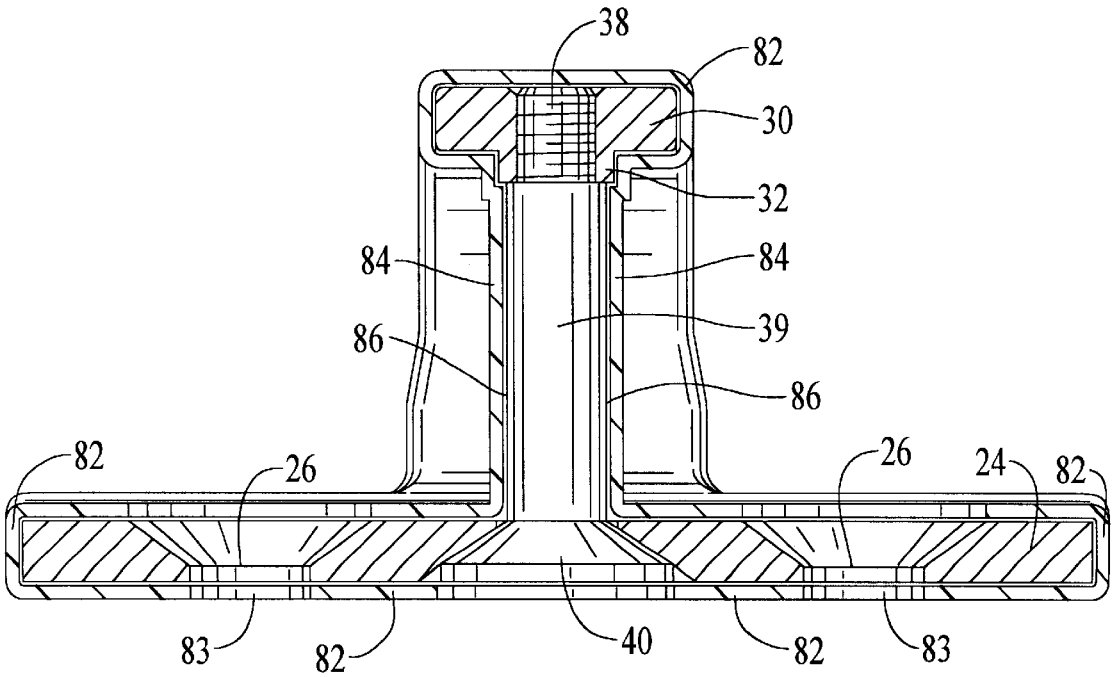
FIG. 16 is a partial cross-sectional view of the door latch striker of FIG. 15 taken generally along the line 16.

FIGS. 12–13A show an embodiment of the striker bolt 36 having a series of annular rings 72 along the length of the shaft 39. As shown in FIG. 13, an effective striker bolt 36 can be made with an annular-ringed shaft 39 installed in a mounting plate 24. The rings 72 may extend along the entire length or just a portion of the shaft 39. As shown in FIG. 13A, the annular rings 72 cooperate with opposite rings on the inside of the overmolded sleeve 76. FIGS. 14 and 14A show an embodiment of the striker bolt 36 having splines 74 along the length of its shaft 39.

In an additional embodiment, shown in FIGS. 15–18, the striker 20 is substantially enveloped with a one-piece plastic cover 82 so as to provide an attractive appearance, further reduce noise, and further resist wear and corrosion. In this embodiment, the cover 82 slides over the U-shaped striker plate 22 so as to almost completely envelop the striker plate 22. The only portion of the striker plate 22 that is not covered by the cover 82 is the support segment 31 of the U-shaped striker plate 22 and the bottom edge 90 of the mounting plate 24 portion of the striker plate 22. Holes through the cover 82 which correspond to the mounting bolt holes 26 and striker bolt hole 28 are also provided. As the striker bolt hole 28 is dimensioned so as to allow the head 40 of the striker bolt 36 to be fully recessed and flush with the mounting plate 24, when the cover 82 is used, the striker assembly 20 is fully insulated from the car body which reduces and dampens noise.

Figure 17:
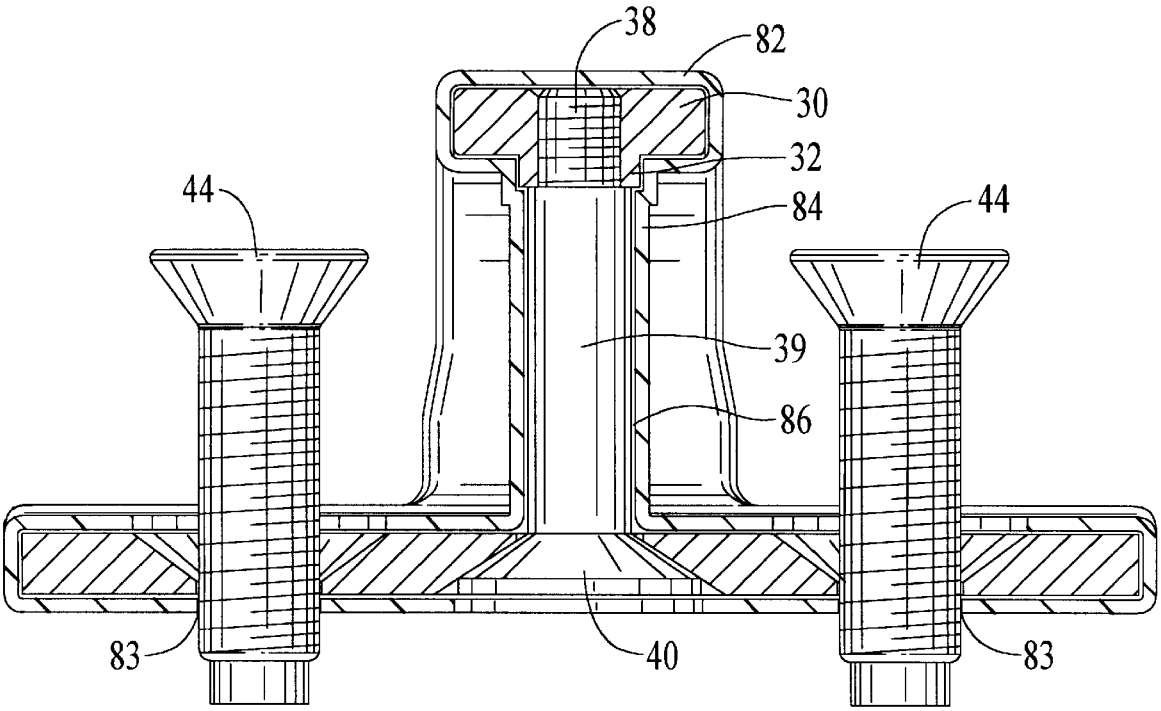
FIG. 17 is a partial cross-sectional view of the door latch striker of FIG. 16 with mounting bolts inserted through the mounting bolt holes and interfering with the cover.
Figure 18:
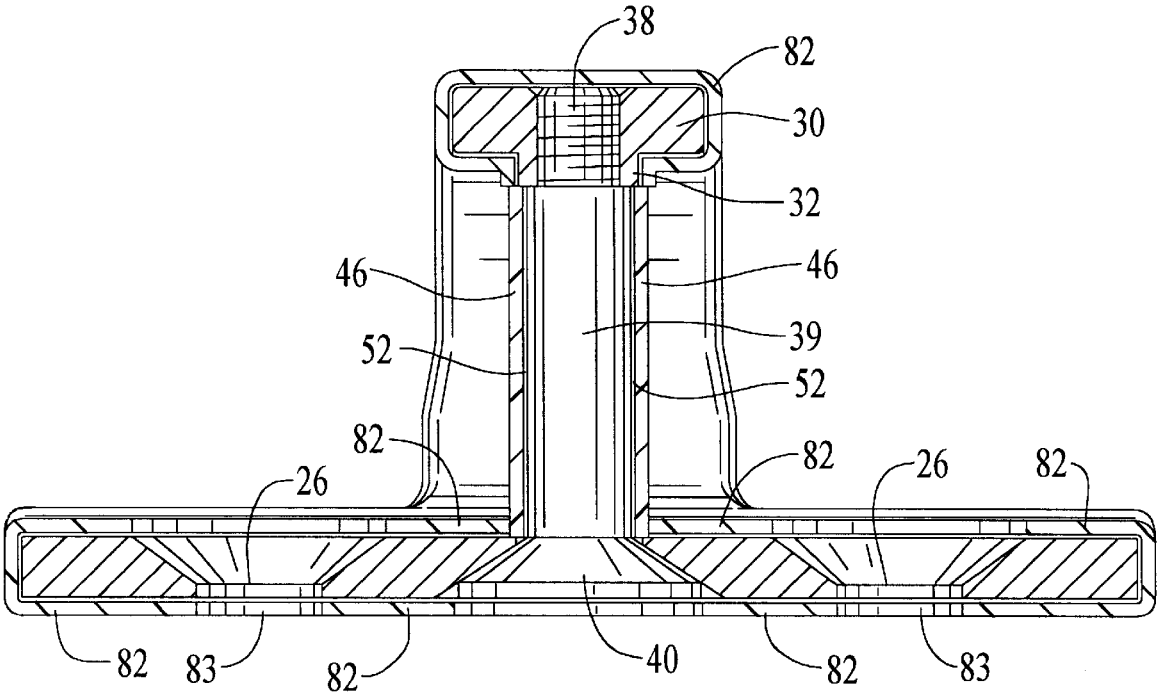
FIG. 18 is a partial cross-sectional view of a door latch striker in accordance with the present invention including an alternative embodiment of a cover.

After the cover 82 is slid over the striker plate 22, the threaded end 38 of the striker bolt 36 is then threaded into the boss 32 to lock the cover 82 over the striker plate 22 and complete the striker assembly 20. The plastic cover 82 may include an integrated sleeve 84 (FIGS. 16 and 17) or one of the previously described extruded, injection molded, or overmolded sleeves may be used (FIG. 18). If an integrated sleeve 84 is used, there is preferably a gap 86 between the shaft 39 of the bolt 36 and the sleeve 84 so as to isolate and dampen sound.

As previously noted, the mounting plate 24 of the U-shaped striker plate 22 has mounting bolt holes 26 therethrough and the striker 20 can be affixed to the vehicle door frame through the mounting bolt holes 26. As shown in FIG. 17, when the striker assembly 20 is covered with a plastic cover 82, the mounting bolts 44 may be partially inserted through the mounting bolt holes 26 and held in place through interference with the holes 83 in the plastic cover 82. Such an arrangement provides the installer with a complete package that may be treated and handled as a single part. This greatly reduces human endeavor and thus facilitates assembly line installation of the striker 20 on the door frame. If such an integrated assembly package is desired, the holes 83 in the cover 82 which correspond with the mounting bolt holes 26 in the mounting plate 24 must have a diameter slightly smaller than the diameter of the mounting bolt holes 26 and the mounting bolts 44.

Figure 19:
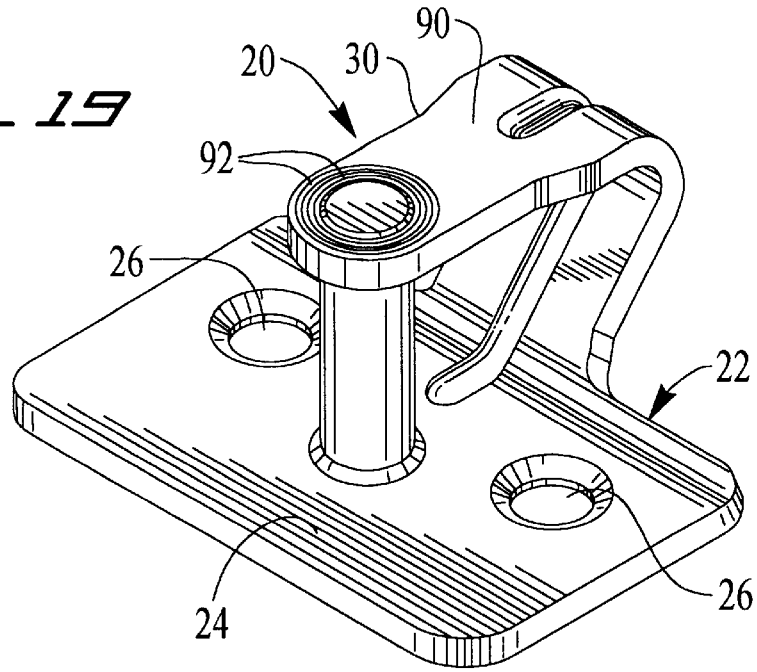
FIG. 19 is a perspective view of another embodiment of a door latch striker constructed in accordance with the present invention.
Figure 20:
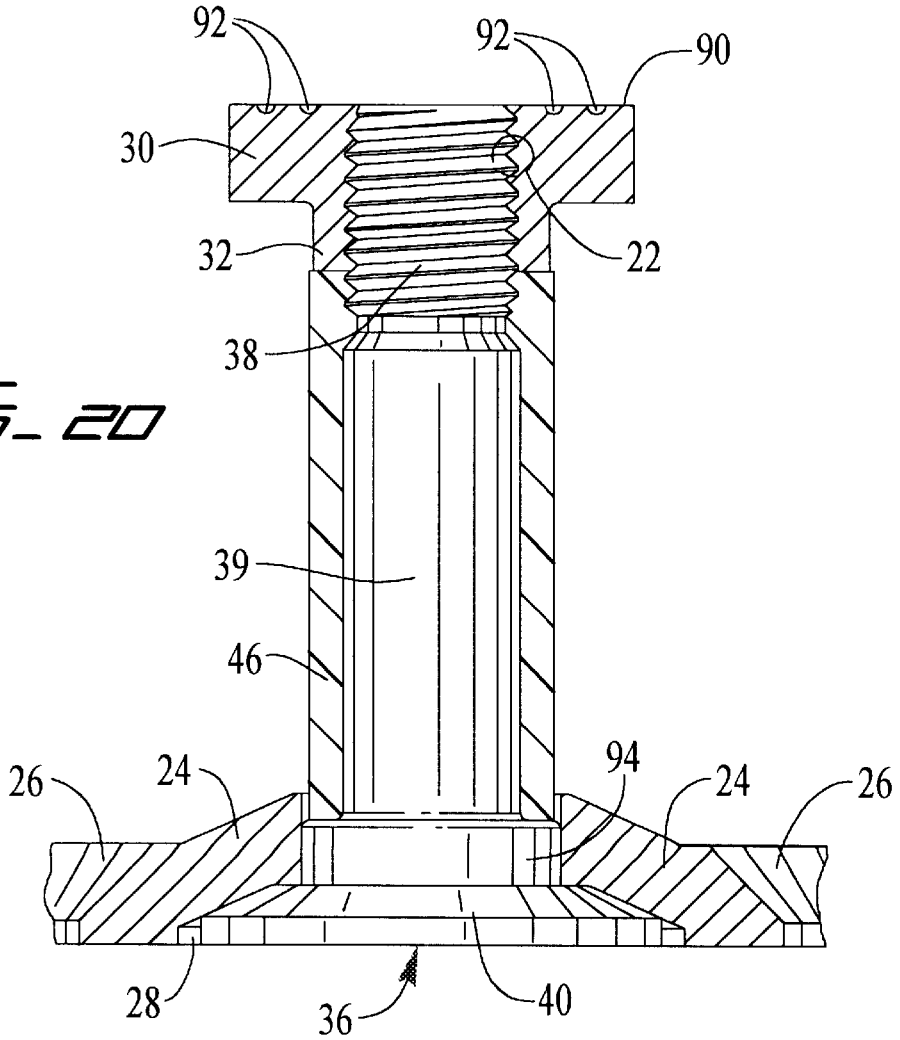
FIG. 20 is a partial cross-sectional view of the door latch striker shown in FIG. 19.

FIG. 19 shows another embodiment of a vehicle door striker 20 constructed in accordance with the present invention. This embodiment, like the one shown in FIGS. 2–5, includes a substantially U-shaped striker plate 22 formed from stamped steel. One arm of the "U" is formed into a mounting plate 24 with mounting bolt holes 26 and a striker bolt hole 28 therethrough. Opposite from the mounting plate 24 in the "U" is an arm 30 that includes a boss 32 with a threaded hole 34 therethrough. On the exterior side 90 of the arm 30 are one or more grooves or rings 92 surrounding the hole 34 through the arm 30. The grooves 92 provide an attractive finish appearance to the vehicle door striker 20. As best seen in FIG. 20, in this embodiment, the striker bolt 36 has a slight shoulder 94 proximate the head 40 end. The shoulder 94 rests within the striker bolt hole 28 in the mounting plate 24 portion of the U-shaped striker plate 22 and provides additional stability to the assembly. In this embodiment, the sleeve 46 rests on the shoulder 94 and extends from the striker bolt hole 28 along the shaft 39 of the striker bolt 36 to the threaded end 38 where it abuts or is proximal the boss 32.

Figure 22:
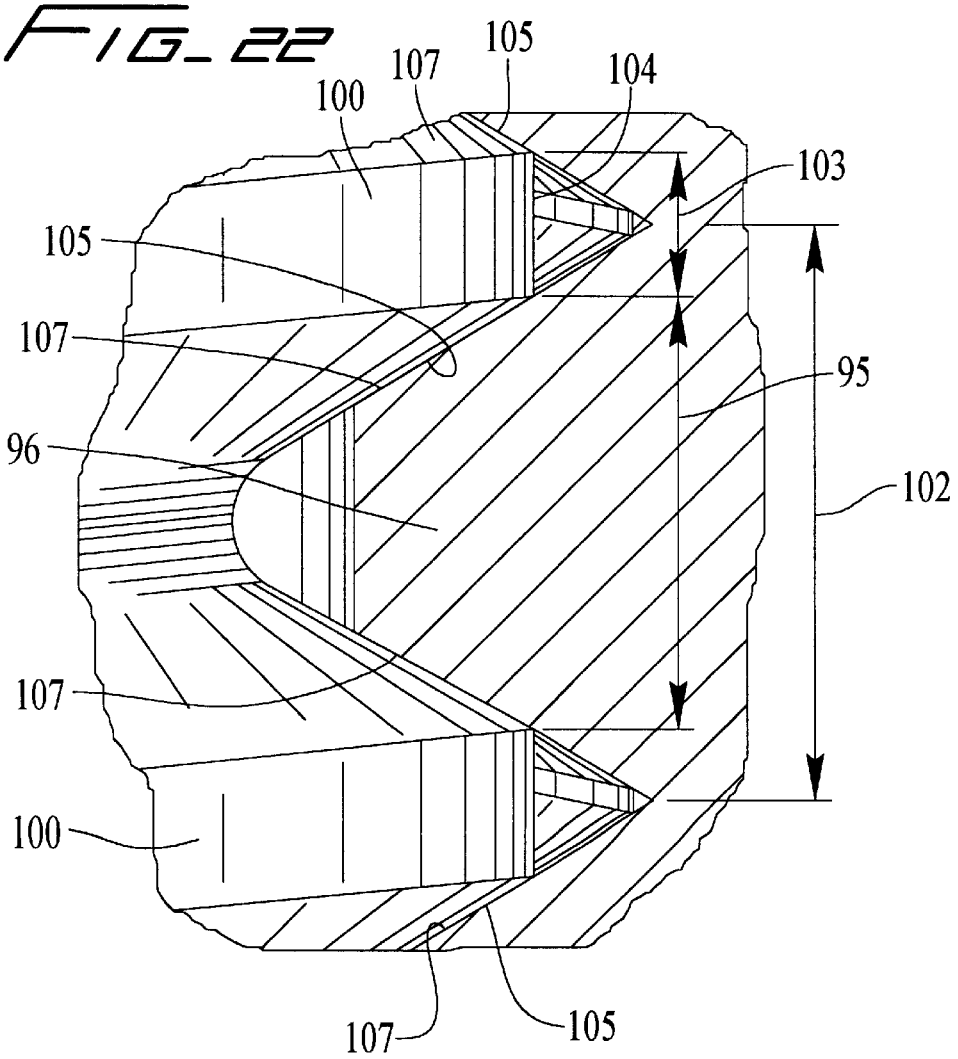
FIG. 22 is a detail of the partial cross-sectional view of the door latch striker shown in FIG. 20.

The threaded engagement between the threaded end 38 of the striker bolt 36 and the threaded hole 34 in the boss 32 and arm 30 can be configured to enhance the strength of the connection while allowing the use of cost-effective materials. Increasing the material strength of the U-shaped striker plate 22, e.g., by heat treating the material or using a high-strength steel, generally carries with it a significant increase in cost. Similarly, while the boss 32 is provided to increase the length of the thread engagement without increasing the overall thickness of the arm 30 and striker plate 22, space constraints dictate the maximum size of the arm 30 and boss 32. As such, it has been found effective to enhance the strength of the connection by using an interference thread proportioned to increase the shear length 95 of the threads 96 in the threaded hole 34 through the boss 32 and arm 30 (FIG. 22). Preferably, the shear length 95 of the threads 96 in the threaded hole 34 is maximized instead of the shear length of the threads 100 on the striker bolt 36 because the striker bolt 36 can typically be more cost-effectively manufactured from high-strength materials than the striker plate 22 can. Ideally, the shear length 95 of the threads 96 in the threaded hole 34 approaches the thread pitch 102 (distance between two successive threads). However, as the shear length 95 approaches the thread pitch 102, the width 103 of the edges 104 of the threads 100 on the striker bolt 36 must become increasingly narrow and sharp as the ratio of the shear length 95 to thread pitch 102 approaches one to one. Sharp threads 100 are fragile and easily damaged prior to assembly and may also pose a danger to people handling the striker bolts 36. As such, it has been found effective to design the threads such that the shear length 95 is between approximately 76% and 90% of the thread pitch 102.

The use of an interference fit between the flanks 105 of the internal threads in the hole 34 through the arm 30 and the flanks 107 of the threads on the striker bolt 36 also provides rotational resistance to movement of the striker bolt 36 within the U-shaped striker plate 22 and helps ensure a desirable, tight, and rattle-free fit. Of course, the threads could also be configured to interfere at the crests or be non-interfering if desired in particular applications. Furthermore, the threaded end 38 of the striker bolt 36 may be used to tap the internal threads in the hole 34 through the boss 32 and arm 30. The primary goal of the threaded design is to increase the strength of the threaded connection and other effective thread designs may be possible in particular applications.

As illustrated by the foregoing description and shown in the Figures, the present invention is more suitable as a vehicle door striker than existing strikers. The present invention overcomes the limitations and disadvantages of existing processes by providing a door striker which is capable of exceeding vehicle manufacturer and governmental safety requirements, is durable and cost effective, and makes a closing sound that is appealing to consumers.

Although the invention has been herein shown and described in what is perceived to be the most practical and preferred embodiments, it is to be understood that the invention is not intended to be limited to those specific embodiments. Rather, it is recognized that modifications may be made by one of skill in the art without departing from the spirit or intent of the invention. Therefore, the invention is to be taken as including all reasonable equivalents to the subject matter of the appended claims.

I claim:

1. A vehicle door striker comprising:

a U-shaped striker plate having a mounting plate connected to an arm by a support segment, the mounting plate having a striker bolt hole and the arm having a hole therethrough; and a striker bolt having a head and a threaded end, the threaded end having threads with flanks, wherein the threaded end of the striker bolt is threaded into the hole through the arm to create an interference fit.

2. The vehicle door striker of claim 1 wherein the interference fit is effectuated by cooperation between the flanks of the threads of the striker bolt with flanks of threads within the hole through the arm.

3. The vehicle door striker of claim 1 wherein the striker bolt has a higher yield strength than that of the U-shaped striker plate.

4. The vehicle door striker of claim 2 wherein the hole through the arm and the threads therewithin extend through a boss protruding from the arm.

5. The vehicle door striker of claim 1 wherein the striker bolt further comprises a shoulder proximate the head, the shoulder resting within the striker bolt hole in the striker plate when the threaded end of the striker bolt is threaded into the hole through the arm.

6. The vehicle door striker of claim 1 wherein the hole through the arm is tapped by the threaded end of the striker bolt to create threads therein.

7. The vehicle door striker of claim 4 wherein the threads within the boss and the arm are created by threading the threaded end of the striker bolt through the hole through the arm and boss.

8. A vehicle door striker comprising:

a mounting plate;

an arm positioned relative to the mounting plate, the arm having an internally threaded hole therethrough, the internal threads in the threaded hole having flanks; and a striker bolt connecting the arm and the mounting plate, the striker bolt having an externally threaded end, the external threads of the threaded end having flanks, wherein the striker bolt is threaded into the hole in the arm to create an interference fit.

9. The vehicle door striker of claim 8 wherein the interference fit is effectuated by cooperation between flanks of the threads in the threaded hole through the arm with flanks of the external threads of the threaded end of the striker bolt.

10. The vehicle door striker of claim 8 wherein the striker bolt has a higher yield strength than that of the arm.

11. The vehicle door striker of claim 9 wherein the internal threads have a shear length and a thread pitch; the shear length of the internal threads being between about seventy-six percent and ninety percent of the thread pitch.

12. The vehicle door striker of claim 8 wherein the threaded hole through the arm and the internal threads therewithin extend through a boss protruding from the arm.

13. The vehicle door striker of claim 8 wherein the striker bolt further comprises a shoulder, the shoulder resting within a striker bolt hole in the mounting plate when the threaded end of the striker bolt is threaded into the internally threaded hole through the arm.

14. The vehicle door striker of claim 8 wherein the internal threads within the threaded hole through the arm are created by threading the threaded end of the striker bolt into the hole through the arm.

15. The vehicle door striker of claim 12 wherein the internal threads through the boss and the arm are created by threading the threaded end of the striker bolt through the boss and the arm.

16. A vehicle door striker comprising:

a mounting plate;

an arm positioned relative to the mounting plate;

a boss protruding from the arm, the boss having a threaded hole therethrough, the threads having flanks; and a striker bolt having a threaded end connecting the mounting plate to the arm through the threaded hole in the boss to achieve an interference fit, the threads of the striker bolt having flanks cooperating with the flanks of the boss and arm hole threads so as to create the interference fit.

17. The vehicle door striker of claim 16 wherein the striker bolt has a higher yields strength than that of the arm and the boss.

18. The vehicle door striker of claim 17 wherein the boss and arm hole threads have a shear length and a thread pitch, the shear length of the boss and arm hole threads being between about seventy-six percent and ninety percent of the thread pitch.

19. The vehicle door striker of claim 16 wherein the striker bolt further comprises a shoulder, the shoulder resting within a striker bolt hole in the mounting plate when the threaded end of the striker bolt is threaded into the boss and arm hole.

20. The vehicle door striker of claim 16 wherein the threads within the boss and arm hole are created by the threaded end of the striker bolt.

* * * * *